US011332983B2

(12) United States Patent
Schultz et al.

(10) Patent No.: US 11,332,983 B2
(45) Date of Patent: May 17, 2022

(54) DOWNHOLE DISCONNECT TOOL

(71) Applicant: THRU TUBING SOLUTIONS, INC., Oklahoma City, OK (US)

(72) Inventors: Roger L. Schultz, Newcastle, OK (US); Timothy Manke, Oklahoma City, OK (US); Brett A. Fears, Mustang, OK (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 0 days.

(21) Appl. No.: 16/813,903

(22) Filed: Mar. 10, 2020

(65) Prior Publication Data

US 2020/0291730 A1 Sep. 17, 2020

Related U.S. Application Data

(60) Provisional application No. 62/818,049, filed on Mar. 13, 2019.

(51) Int. Cl.
*E21B 17/043* (2006.01)
*E21B 19/16* (2006.01)
*E21B 19/18* (2006.01)

(52) U.S. Cl.
CPC ..... *E21B 17/043* (2013.01); *E21B 19/16* (2013.01); *E21B 19/18* (2013.01)

(58) Field of Classification Search
CPC ..... E21B 19/16; E21B 19/18; E21B 17/043
See application file for complete search history.

(56) References Cited

U.S. PATENT DOCUMENTS 1,883,071 A * 10/1932 Stone ..... E21B 17/06 166/194
3,895,829 A * 7/1975 Manson, Jr. ..... E21B 17/043 285/3
5,501,099 A 3/1996 Whorff
6,564,868 B1 5/2003 Ferguson et al.
6,854,341 B2 2/2005 Oddie et al.
8,020,619 B1 9/2011 Robertson et al.
8,678,079 B2 3/2014 Clem et al.
(Continued)

OTHER PUBLICATIONS

U.S. Office Action dated Mar. 3, 2020 for U.S. Appl. No. 16/441,083, 10 pages.

(Continued)

*Primary Examiner* — D. Andrews
(74) *Attorney, Agent, or Firm* — Smith IP Services, P.C.

(57) ABSTRACT

A downhole disconnect tool can include outer housing sections connected to each other with threads, and an inner sleeve received in at least one of the outer housing sections, whereby the inner sleeve limits relative rotation between the outer housing sections in a connect position, and permits relative rotation between the outer housing sections in a disconnect position. A method of disconnecting portions of a tubular string can include connecting a downhole disconnect tool between the tubular string portions, deploying a plug into the tubular string, thereby engaging the plug with an inner sleeve in the downhole disconnect tool, applying a differential pressure across the plug, thereby displacing the inner sleeve relative to outer housing sections of the downhole disconnect tool, and then unthreading the outer housing sections from each other in the well.

20 Claims, 8 Drawing Sheets

(56) References Cited

U.S. PATENT DOCUMENTS

| | | | |
|---|---|---|---|
| 8,936,088 | B2 | 1/2015 | Misselbrook et al. |
| 9,145,758 | B2 * | 9/2015 | King ..... E21B 34/103 |
| 9,745,813 | B2 | 8/2017 | Robertson et al. |
| 10,975,643 | B2 | 4/2021 | Schultz et al. |
| 2004/0089450 | A1 | 5/2004 | Slade et al. |
| 2005/0051323 | A1 | 3/2005 | Fripp et al. |
| 2006/0201675 | A1 | 9/2006 | Ferguson et al. |
| 2011/0284224 | A1 | 11/2011 | Misselbrook et al. |
| 2012/0018158 | A1 | 1/2012 | Misselbrook et al. |
| 2012/0031615 | A1 | 2/2012 | Connell et al. |
| 2014/0034315 | A1 | 2/2014 | Tallini et al. |
| 2016/0215580 | A1 | 7/2016 | Lehr |
| 2017/0030156 | A1 | 2/2017 | Churchill |
| 2017/0037707 | A1 | 2/2017 | Churchill |
| 2017/0145765 | A1 | 5/2017 | Umphries et al. |

OTHER PUBLICATIONS

Thru Tubing Solutions; "Hydraulic Disconnect", company article via www.thrutubingsolutions.com, dated 2015, 4 pages.
International Search Report with Written Opinion dated Jun. 26, 2020 for PCT Patent Application No. PCT/US2020/021517, 12 pages.
Office Action dated Oct. 11, 2019 for U.S. Appl. No. 16/441,083, 17 pages.
Office Action dated Jul. 13, 2020 for U.S. Appl. No. 16/441,083, 11 pages.
Office Action dated Jan. 19, 2021 for U.S. Appl. No. 16/441,083, 4 pages.
Office Action issued for U.S. Appl. No. 17/196,972, dated Aug. 3, 2021, 20 pages.
Office Action issued for U.S. Appl. No. 17/196,972, dated Jan. 2022, 10 pages.

* cited by examiner

DOWNHOLE DISCONNECT TOOL

CROSS-REFERENCE TO RELATED APPLICATION

This application claims the benefit of the filing date of U.S. provisional application No. 62/818,049 filed on 13 Mar. 2019. The entire disclosure of this prior application is incorporated herein in its entirety for all purposes.

BACKGROUND

This disclosure relates generally to equipment utilized and operations performed in conjunction with a subterranean well and, in an example described below, more particularly provides a downhole disconnect tool.

It can be useful to be able to disconnect portions of a tubular string from each other in a well. For example, in the event that a bottom hole assembly or other lower portion of the tubular string becomes stuck in the well, an upper portion of the tubular string can be retrieved by disconnecting the upper portion from the lower portion in the well. The lower portion can be bypassed (for example, using side tracking techniques) or retrieved (for example, using fishing tools) after the upper portion is retrieved from the well.

Therefore, it will be readily appreciated that improvements are continually needed in the art of deploying and retrieving tubular strings in wells. The disclosure below provides such improvements, which may be utilized in a variety of different well operations (including, but not limited to, drilling, completion, stimulation, production and injection operations).

DETAILED DESCRIPTION

Figure 1:
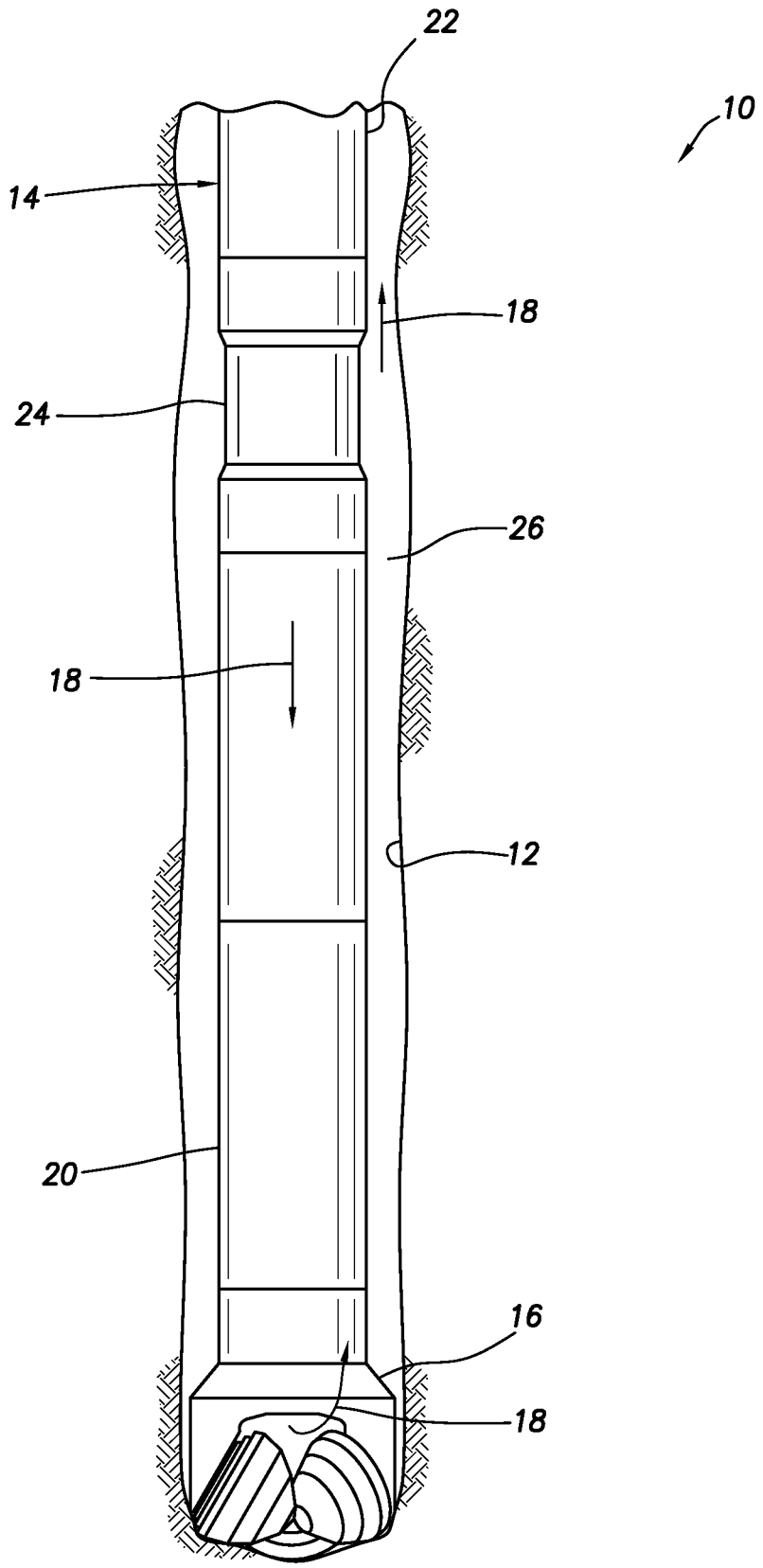
FIG. 1 is a representative partially cross-sectional view of an example of a well system and associated method which can embody principles of this disclosure.

Representatively illustrated in FIG. 1 is a well system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is being drilled using a drill string 14. For this purpose, the drill string 14 includes a drill bit 16 connected at a distal end of the drill string. The drill bit 16 may be rotated to drill the wellbore 12 deeper, for example, by rotating the drill string 14 from the surface (e.g., using a rotary table or top drive of a land- or water-based drilling rig), and/or by flowing drilling fluid 18 through a drilling motor 20 connected in the drill string above the drill bit. The drilling motor 20 could be a positive-displacement or Moineau-type drilling motor, or a turbine-type drilling motor.

The drilling fluid 18 is flowed through the drill string 14 (e.g., using rig mud pumps at surface). The drilling fluid 18 exits the distal end of the drill string 14 via nozzles in the drill bit 16 and returns to the surface via an annulus 26 formed between the drill string and the wellbore 12.

The drill string 14 may comprise one or more tubulars 22 extending to surface. The tubulars 22 could include individual connected-together drill pipes, or a continuous tubular of the type known to those skilled in the art as coiled tubing. Any type of tubular(s) may be used in the drill string 14 in keeping with the principles of this disclosure.

In order to allow the tubulars 22 to be retrieved from the wellbore 12 in the event that the drill bit 16, drilling motor 20 and/or other components of the drill string 14 become stuck in the wellbore during the drilling operation, a disconnect tool 24 is connected between the tubulars and the remainder of the bottom hole assembly (including the drilling motor and the drill bit in this example). The disconnect tool 24 may be connected at any position along the drill string 14, and may be connected between any particular components of the drill string, in keeping with the principles of this disclosure.

After the disconnect tool 24 has been used to separate upper and lower portions of the drill string 14, the upper portion can be withdrawn from the wellbore 12 to the surface. The lower portion can then be bypassed or retrieved from the wellbore 12, for example, using specialized "fishing" tools of the type well known to those skilled in the art.

Figure 2:
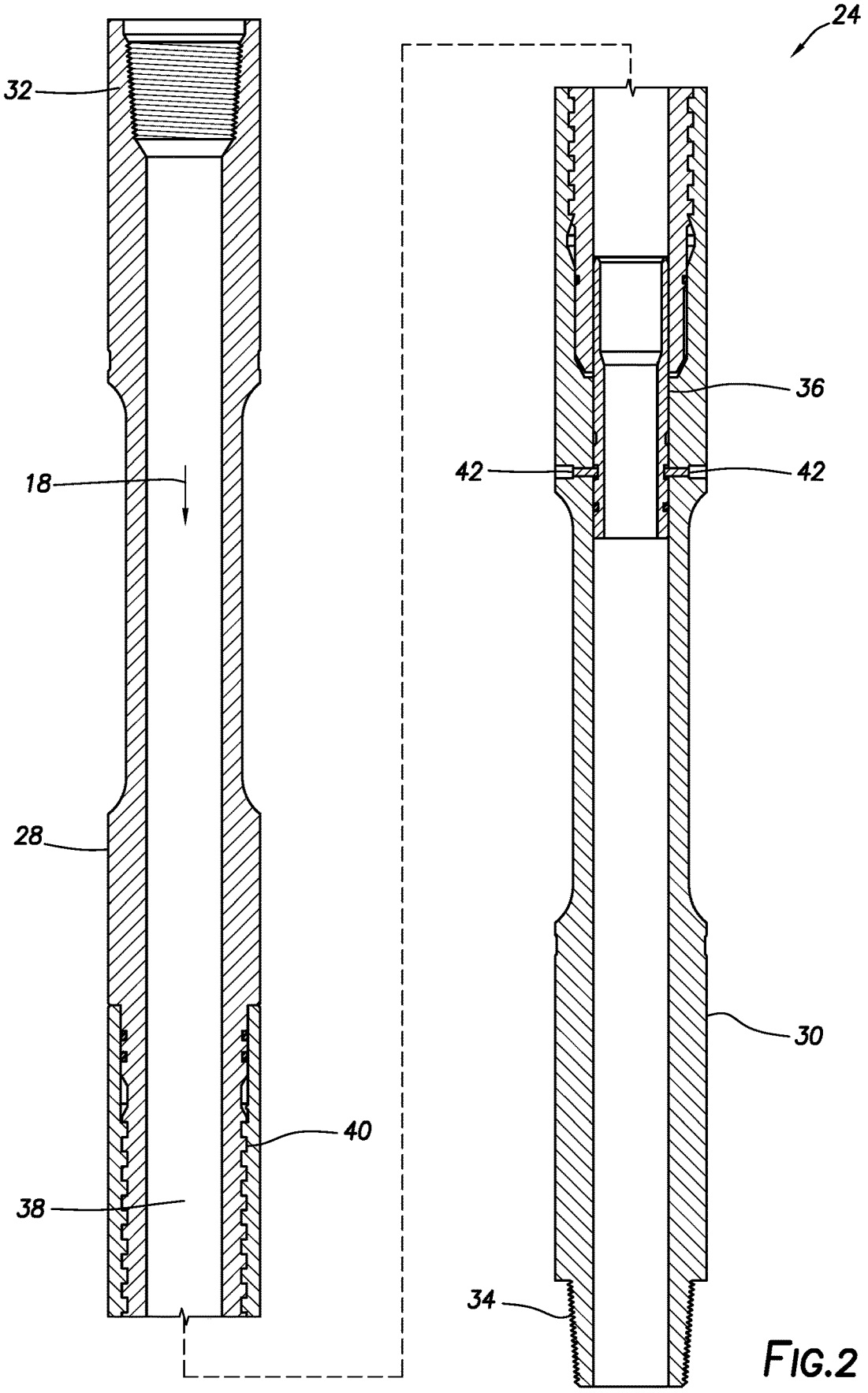
FIG. 2 is a representative cross-sectional view of a downhole disconnect tool which may be used in the system and method of FIG. 1, and which can embody the principles of this disclosure.

Referring additionally now to FIG. 2, an example of the disconnect tool 24 is representatively illustrated, apart from the remainder of the well system 10. The disconnect tool 24 may be used with other systems and methods in keeping with the principles of this disclosure.

In the FIG. 2 example, the disconnect tool 24 includes upper and lower generally tubular outer housing sections 28, 30 configured to be connected in the drill string 14, for example, by threading. An upper threaded connector 32 is provided in the upper outer housing section 28 and a lower threaded connector 34 is provided on the lower outer housing section 30 in this example.

The upper and lower outer housing sections 28, 30 are secured to each other by means of threads 40. Preferably, the threads 40 have a relatively coarse pitch and are configured such that they can be readily unthreaded downhole when desired, by producing an appropriate rotation of the drill string 14 above the disconnect tool 24 (e.g., using a rotary table or top drive at the surface). For example, if the threads 40 are right-handed, a counter-clockwise rotation of the drill string 14 as viewed from the surface may be used to unthread the upper outer housing section 28 from the lower outer housing section 30 downhole.

However, initially a generally tubular inner sleeve 36 secured in an interior flow passage 38 of the upper and lower outer housing sections 28, 30 prevents unthreading of the outer housing sections. In the FIG. 2 example, the inner sleeve 36 is initially secured in position by one or more shear members 42, so that the inner sleeve engages both of the upper and lower outer housing sections 28, 30 and prevents (or at least limits) substantial relative rotation between the outer housing sections.

Figure 3:
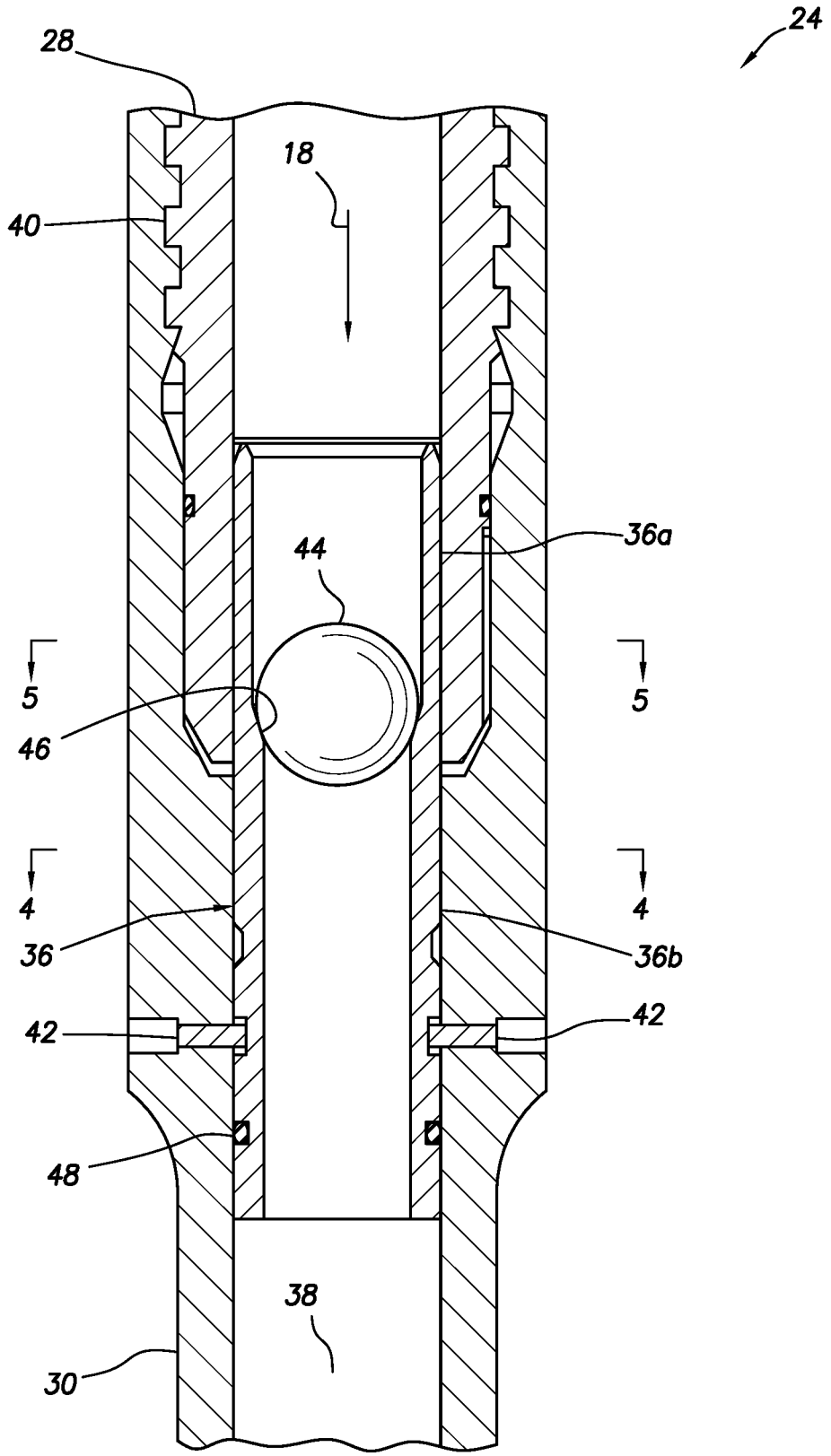
FIG. 3 is a representative cross-sectional view of a portion of the downhole disconnect tool with an inner sleeve thereof in a connect position.

Referring additionally now to FIG. 3, an enlarged view of the inner sleeve 36 engaged with the upper and lower outer housing sections 28, 30 is representatively illustrated. In this view, it may be seen that an upper portion 36*a* of the inner sleeve 36 is received in the upper outer housing section 28 and a lower portion 36*b* of the inner sleeve 36 is received in the lower outer housing section 30.

The shear members 42 prevent downward displacement of the inner sleeve 36 relative to the outer housing sections 28, 30. A seal 48 seals between the inner sleeve 36 and the lower outer housing section 30.

When it is desired to separate the outer housing sections 28, 30, a plug 44 (such as, a ball or dart) is launched into the flow passage 38 and the plug displaces through the drill string 14 into the inner sleeve 36. The plug 44 engages a seat 46 formed in the inner sleeve 36, so that a pressure differential can be created across the inner sleeve 36 and the plug 44 due to the flow of the fluid 18 through the passage 38.

Note that it is not necessary for the plug 44 to completely seal off the flow passage 38 in the inner sleeve 36. The plug 44 could substantially restrict flow of the fluid 18 through the passage 38, so that the pressure differential can be created across the inner sleeve 36 and the plug.

When the pressure differential increases to a predetermined level, the shear members 42 will shear and thereby permit the inner sleeve 36 to displace downward. This downward displacement of the inner sleeve 36 will cause the upper portion 36*a* to disengage from the upper outer housing section 28.

When the inner sleeve 36 disengages from the upper outer housing section 28, the upper outer housing section can be unthreaded from the lower outer housing section 30 as described above. The upper outer housing section 28 and the remainder of the drill string 14 above the disconnect tool 24 can then be retrieved from the wellbore 12. The lower outer housing section 30 and the remainder of the drill string 14 below the disconnect tool 24 can be bypassed or retrieved later, for example, using fishing tools as described above.

Figure 4:
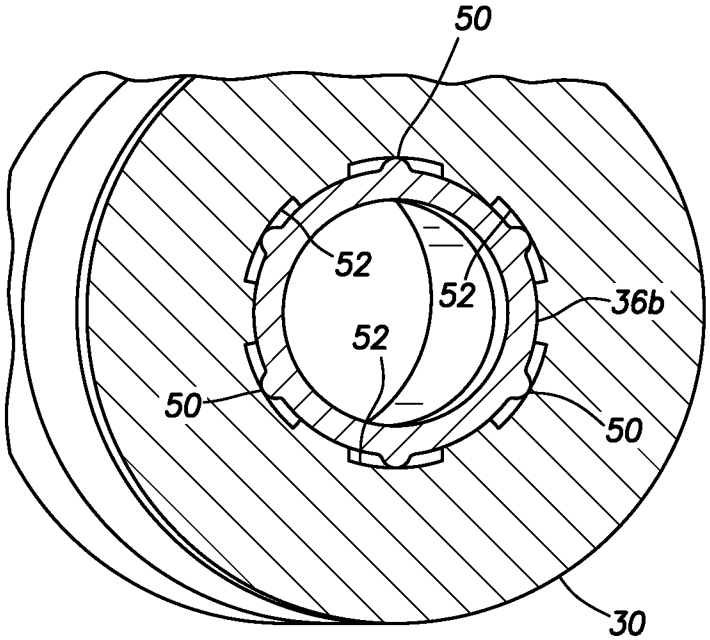
FIG. 4 is a representative cross-sectional view of the downhole disconnect tool, taken along line 4-4 of FIG. 3.

Referring additionally now to FIG. 4, a perspective cross-sectional view of the inner sleeve lower portion 36*b* engaged in the lower outer housing section 30 is representatively illustrated. In this view it may be seen that longitudinally extending, circumferentially distributed and spaced apart external splines 50 are formed on the inner sleeve 36.

The external splines 50 engage longitudinally extending, circumferentially distributed and spaced apart grooves 52 formed in the lower outer housing section 30. The engagement between the external splines 50 and the internal grooves 52 prevents (or at least limits) substantial relative rotation between the inner sleeve 36 and the lower outer housing section 30.

Figure 5:
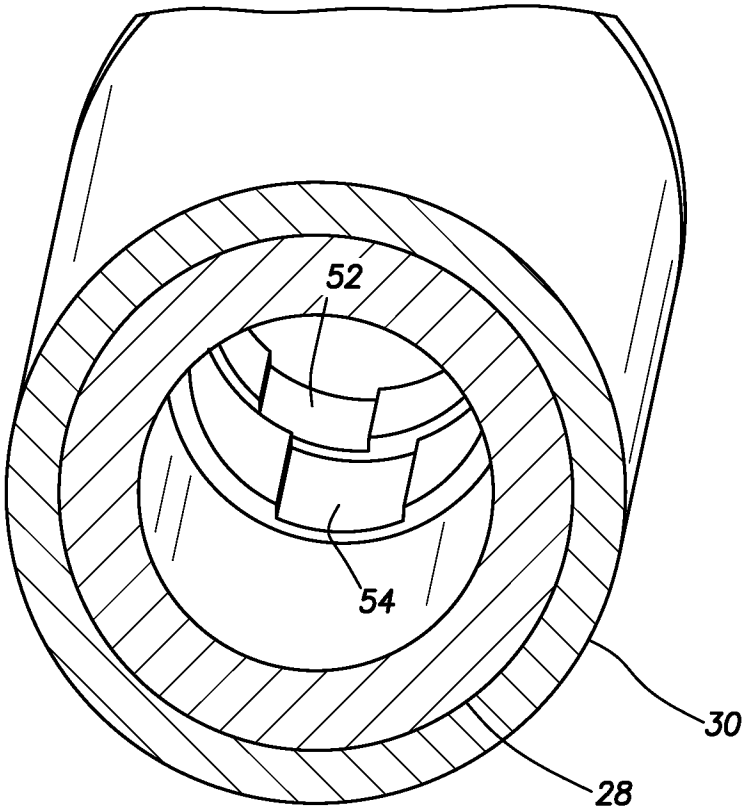
FIG. 5 is a representative cross-sectional view of the downhole disconnect tool, taken along line 5-5 of FIG. 3.

As depicted in FIG. 5, similar internal grooves 54 are formed in the upper outer housing section 28. The internal grooves 52, 54 are configured so that, no matter a relative rotational orientation between the upper and lower outer housing sections 28, 30, there will be some rotational overlap between the grooves, so that the external splines 50 on the inner sleeve 36 can engage both sets of grooves.

The engagement between the external splines 50 and the internal grooves 54 prevents (or at least limits) substantial relative rotation between the inner sleeve 36 and the upper outer housing section 28, with the inner sleeve positioned as depicted in FIG. 3. Thus, the inner sleeve 36 can transmit torque between the upper and lower outer housing sections 28, 30 during drilling operations, and can prevent substantial relative rotation between the outer housing sections, due to the engagement of the external splines 50 with both of the sets of internal grooves 52, 54, until the inner sleeve is shifted downward out of engagement with the upper outer housing section as described above.

Figure 6:
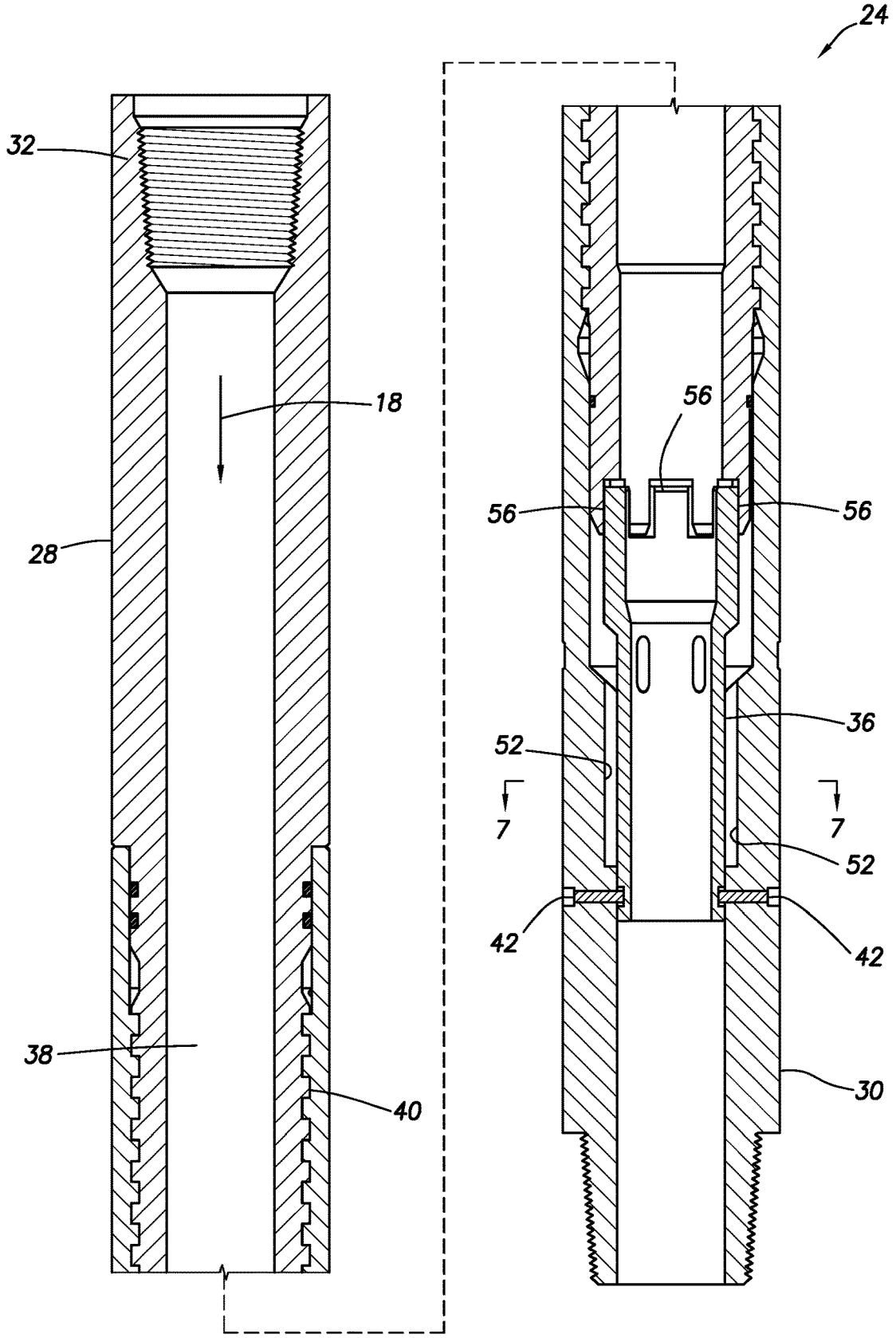
FIG. 6 is a representative cross-sectional view of another example of the downhole disconnect tool with an inner sleeve thereof in a connect position.

Referring additionally now to FIG. 6, another example of the disconnect tool 24 is representatively illustrated. In this example, the inner sleeve 36 is engaged with the upper outer housing section 28 by means of complementarily configured castellations 56 formed on the inner sleeve and the upper outer housing section. The engagement between the castellations 56 prevents substantial relative rotation between the inner sleeve 36 and the upper outer housing section 28, until the inner sleeve is shifted downward.

Figure 7:
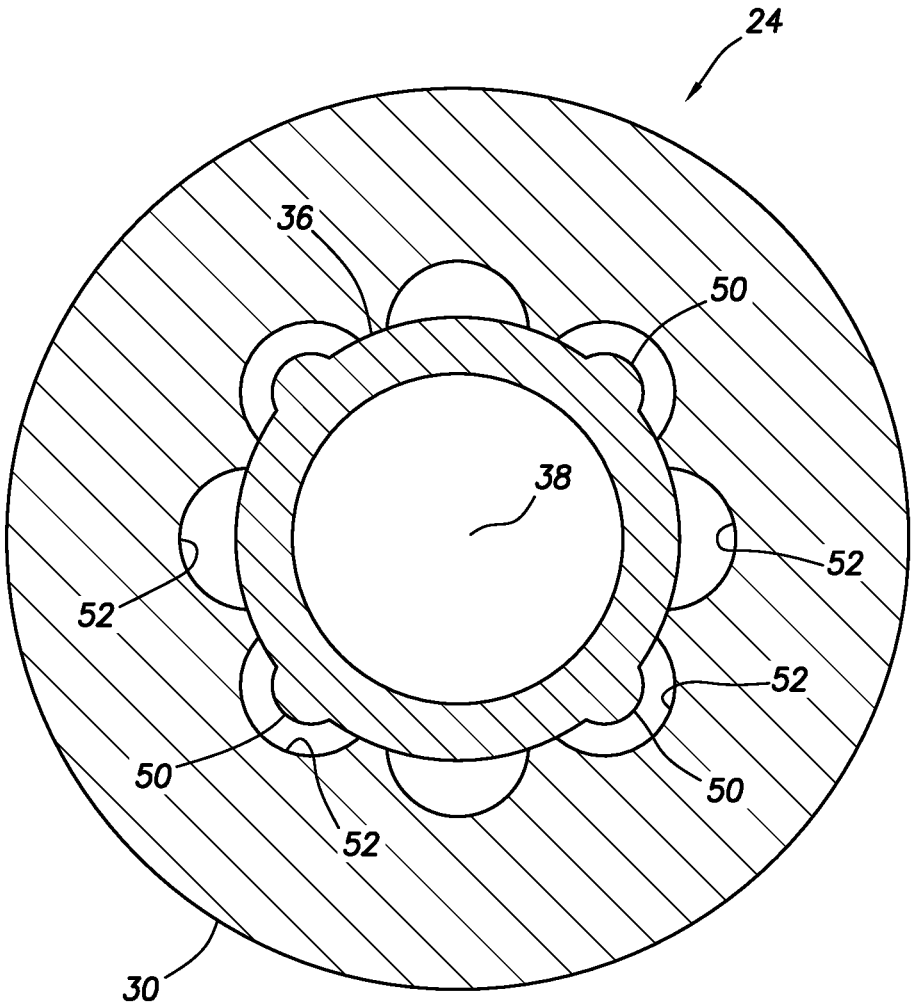
FIG. 7 is a representative cross-sectional view of the FIG. 6 downhole disconnect tool, taken along line 7-7 of FIG. 6.

Referring now to FIG. 7, a cross-sectional view, taken along line 7-7 of FIG. 6 is representatively illustrated. In this view, it may be seen that the external splines 50 on the inner sleeve 36 and the internal grooves 52 in the lower outer housing section 30 are differently configured as compared to those depicted above for the example of FIGS. 2-5. However, the engagement between the external splines 50 and the internal grooves 52 still prevents unthreading of the upper and lower outer housing sections 28, 30, as long as the inner sleeve 36 remains engaged with the upper outer housing section via the castellations 56.

Figure 8:
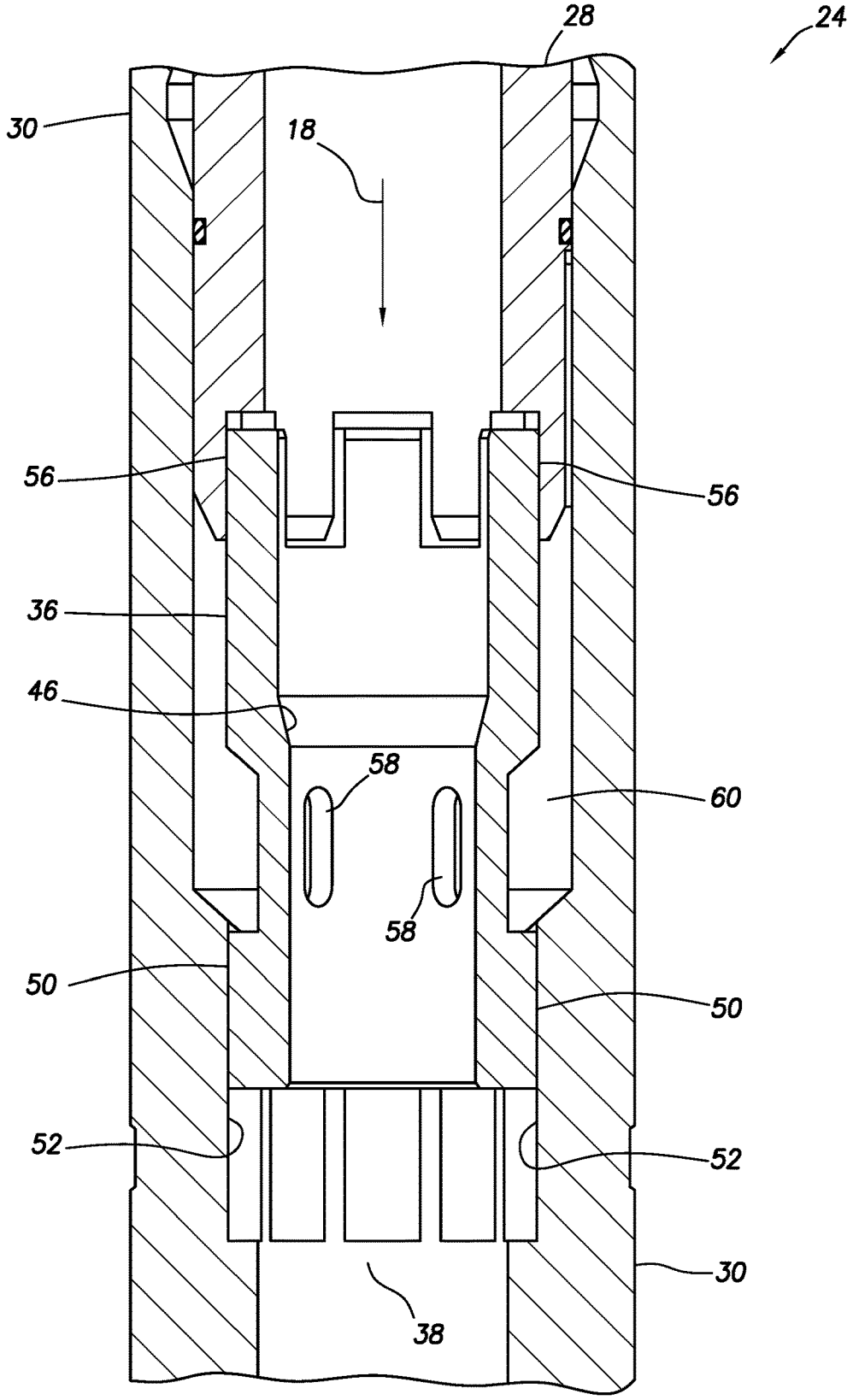
FIG. 8 is a representative cross-sectional view of a portion of another example of the downhole disconnect tool with an inner sleeve thereof in a connect position.

Referring now to FIG. 8, an enlarged cross-sectional view of the inner sleeve 36 engaged with both of the upper and lower outer housing sections 28, 30 is representatively illustrated. In this view, it may be seen that openings 58 are formed through the inner sleeve 36 below the seat 46. The openings 58 provide for fluid communication between the flow passage 38 and an annulus 60 formed radially between the inner sleeve 36 and the lower outer housing section 30.

Figure 9:
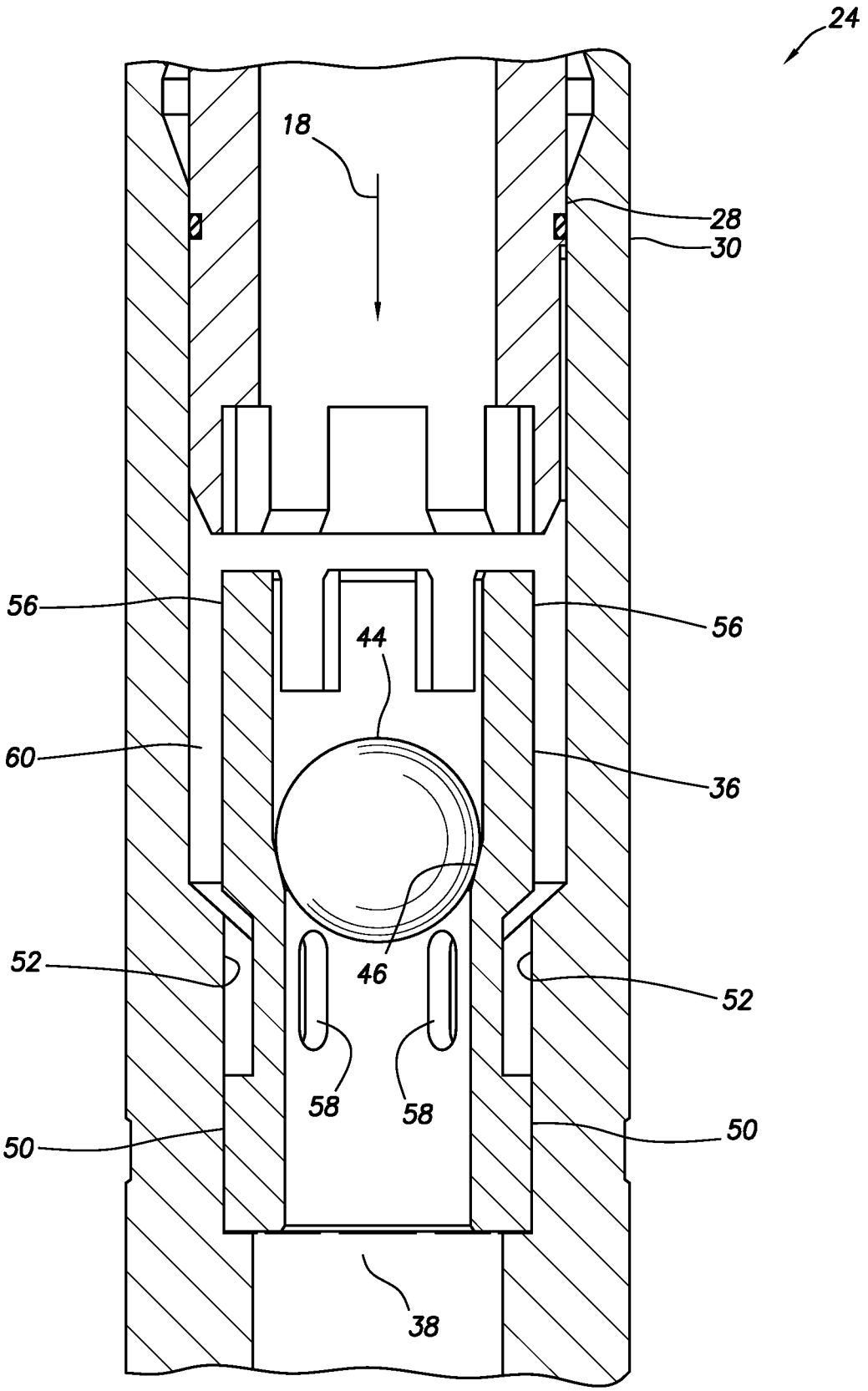
FIG. 9 is a representative cross-sectional view of the portion of the FIG. 8 downhole disconnect tool with the inner sleeve in a disconnect position.

Referring now to FIG. 9, the disconnect tool 24 is representatively illustrated after the plug 44 has engaged the seat 46 and a predetermined pressure differential caused by flow of the fluid 18 has sheared the shear members 42 and displaced the inner sleeve 36 downward relative to the upper outer housing section 28. The castellations 56 are now disengaged from the upper outer housing section 28. Relative rotation is now permitted between the upper outer housing section 28 and each of the inner sleeve 36 and the lower outer housing section 30, so that the upper and lower outer housing sections can be unthreaded as described above.

Note that the openings 58 permit continued flow of fluid between the flow passage 38 above and below the inner sleeve 36, after the upper outer housing section 28 is unthreaded from the lower outer housing section 30. This allows fluid to be circulated through the drill string 14 below the disconnect tool 24, if desired (for example, during a fishing operation). However, it is not necessary for the openings 58 to be provided in the inner sleeve 36 in keeping with the principles of this disclosure.

Although the disconnect tool 24 is described above as it may be used with a drilling operation, the scope of this disclosure is not limited to use with drilling operations. For example, the disconnect tool 24 could be used with other operations (such as, completion, production, stimulation or injection operations), and could be connected in tubular strings other than a drill string.

It may now be fully appreciated that the above disclosure provides significant benefits to the art of deploying and retrieving tubular strings in a well. In examples described above, portions of a tubular string (such as the drill string 14) can be disconnected by unthreading the upper outer housing section 28 from the lower outer housing section 30 after displacing the inner sleeve 36 out of engagement with the upper outer housing section.

A downhole disconnect tool 24 for use in a subterranean well is provided to the art by the above disclosure. In one example, the downhole disconnect tool 24 can comprise first and second outer housing sections 28, 30 connected to each other with threads 40, and an inner sleeve 36 received in at least the second outer housing section 30 and having connect and disconnect positions. The inner sleeve 36 limits relative rotation between the first and second outer housing sections 28, 30 in the connect position, and permits relative rotation between the first and second outer housing sections 28, 30 in the disconnect position.

The inner sleeve 36 may transmit torque between the first and second outer housing sections 28, 30 in the connect position of the inner sleeve 36.

Relative rotation between the first outer housing section 28 and the inner sleeve 36 may be limited in the connect position of the inner sleeve 36. Relative rotation between the second outer housing section 30 and the inner sleeve 36 may be limited in the connect position of the inner sleeve 36. Relative rotation between the second outer housing section 30 and the inner sleeve 36 may be limited in the disconnect position of the inner sleeve 36. Relative rotation between the first outer housing section 28 and the inner sleeve 36 may be permitted in the disconnect position of the inner sleeve 36.

Castellations formed on the inner sleeve 36 may be engaged with the first outer housing section 28 in the connect position of the inner sleeve 36. Splines 50 formed on the inner sleeve 36 may be engaged with grooves 54 formed in the first outer housing section 28 in the connect position of the inner sleeve 36. Splines 50 formed on the inner sleeve 36 may be engaged with grooves 52 formed in the second outer housing section 30 in the connect and disconnect positions of the inner sleeve 36.

A plug seat 46 may be formed in the inner sleeve 36. One or more openings 58 may provide fluid communication between an interior of the inner sleeve 36 and an annulus 60 formed radially between the inner sleeve 36 and the second outer housing section 30.

A method of disconnecting first and second portions of a tubular string (such as the drill string 14) in a subterranean well is also provided to the art by the above disclosure. In one example, the method can comprise connecting a downhole disconnect tool 24 between the first and second portions of the tubular string 14; deploying a plug 44 into the tubular string 14 in the well, thereby engaging the plug 44 with an inner sleeve 36 in the downhole disconnect tool 24; applying a differential pressure across the plug 44 while the plug 44 is engaged with the plug seat 46, thereby displacing the inner sleeve 36 relative to first and second outer housing sections 28, 30 of the downhole disconnect tool 24; and then unthreading the first outer housing section 28 from the second outer housing section 30 in the well.

The displacing step may include disengaging the inner sleeve 36 from the first outer housing section 36. The disengaging step may include disengaging castellations 56 formed on the inner sleeve 36 from the first outer housing section 28. The disengaging step may include disengaging splines 50 formed on the inner sleeve 36 from the first outer housing section 28.

The connecting step may include the inner sleeve 36 limiting relative rotation between the first and second outer housing sections 28, 30. The connecting step may include the inner sleeve 36 transmitting torque between the first and second outer housing sections 28, 30.

The method may include, after the displacing step, permitting fluid communication between an interior of the inner sleeve 36 and an annulus 60 formed radially between the inner sleeve 36 and the second outer housing section 30.

In the connecting step, relative rotation between the inner sleeve 36 and the first outer housing section 28 may be limited by engagement between the inner sleeve 36 and the first outer housing section 28. In the connecting step, relative rotation between the inner sleeve 36 and the second outer housing section 30 may be limited by engagement between the inner sleeve 36 and the second outer housing section 30. In the unthreading step, relative rotation between the inner sleeve 36 and the second outer housing section 30 may be limited by engagement between the inner sleeve 36 and the second outer housing section 30.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A downhole disconnect tool for use in a subterranean well, the downhole disconnect tool, comprising:

first and second outer housing sections connected to each other with threads; and an inner sleeve received in at least the second outer housing section and having connect and disconnect positions, in which the inner sleeve limits relative rotation between the first and second outer housing sections in the connect position, in which the inner sleeve permits relative rotation between the first and second outer housing sections in the disconnect position, and in which the inner sleeve comprises at least one opening extending radially from an inner surface to an outer surface of the inner sleeve, thereby providing fluid communication between an interior of the inner sleeve and an annulus formed radially between the inner sleeve and the second outer housing section when the inner sleeve is in the connect and disconnect positions.

2. The downhole disconnect tool of claim 1, in which the inner sleeve transmits torque between the first and second outer housing sections in the connect position of the inner sleeve.

3. The downhole disconnect tool of claim 1, in which relative rotation between the first outer housing section and the inner sleeve is limited in the connect position of the inner sleeve.

4. The downhole disconnect tool of claim 3, in which relative rotation between the second outer housing section and the inner sleeve is limited in the connect position of the inner sleeve.

5. The downhole disconnect tool of claim 4, in which relative rotation between the second outer housing section and the inner sleeve is limited in the disconnect position of the inner sleeve.

6. The downhole disconnect tool of claim 5, in which relative rotation between the first outer housing section and the inner sleeve is permitted in the disconnect position of the inner sleeve.

7. The downhole disconnect tool of claim 1, in which castellations formed on the inner sleeve are engaged with the first outer housing section in the connect position of the inner sleeve.

8. The downhole disconnect tool of claim 1, in which splines formed on the inner sleeve are engaged with grooves formed in the first outer housing section in the connect position of the inner sleeve.

9. The downhole disconnect tool of claim 1, in which splines formed on the inner sleeve are engaged with grooves formed in the second outer housing section in the connect and disconnect positions of the inner sleeve.

10. The downhole disconnect tool of claim 1, in which a plug seat is formed in the inner sleeve, and in which the at least one opening is formed below the plug seat.

11. A method of disconnecting first and second portions of a tubular string in a subterranean well, the method comprising:

connecting a downhole disconnect tool between the first and second portions of the tubular string;

deploying a plug into the tubular string in the well, thereby engaging the plug with an inner sleeve in the downhole disconnect tool, in which the inner sleeve comprises a plug seat and at least one opening formed below the plug seat, the at least one opening extending radially from an inner surface to an outer surface of the inner sleeve;

applying a differential pressure across the plug while the plug is engaged with the plug seat, thereby displacing the inner sleeve from a first position to a second position, the at least one opening permitting fluid communication between a first flow passage above the inner sleeve and a second flow passage below the inner sleeve when the inner sleeve is in the second position; and then unthreading a first outer housing section of the downhole disconnect tool from a second outer housing section of the downhole disconnect tool in the well, thereby disconnecting the first and second portions of the tubular string.

12. The method of claim 11, in which the displacing comprises disengaging the inner sleeve from the first outer housing section.

13. The method of claim 12, in which the disengaging comprises disengaging castellations formed on the inner sleeve from the first outer housing section.

14. The method of claim 12, in which the disengaging comprises disengaging splines formed on the inner sleeve from the first outer housing section.

15. The method of claim 11, in which the connecting further comprises the inner sleeve limiting relative rotation between the first and second outer housing sections.

16. The method of claim 11, in which the connecting further comprises the inner sleeve transmitting torque between the first and second outer housing sections.

17. The method of claim 11, further comprising permitting fluid communication between an interior of the inner sleeve and an annulus formed radially between the inner sleeve and the second outer housing section via the at least one opening when the inner sleeve is in the first and second positions.

18. The method of claim 11, in which, in the connecting, relative rotation between the inner sleeve and the first outer housing section is limited by engagement between the inner sleeve and the first outer housing section.

19. The method of claim 18, in which, in the connecting, relative rotation between the inner sleeve and the second outer housing section is limited by engagement between the inner sleeve and the second outer housing section.

20. The method of claim 11, in which, in the unthreading, relative rotation between the inner sleeve and the second outer housing section is limited by engagement between the inner sleeve and the second outer housing section.

* * * * *